United States Patent [19]

Nos

[11] 3,959,835

[45] June 1, 1976

[54] INFLATABLE AIR MATTRESS

[75] Inventor: Rudolph Nos, Rock Forest, Canada

[73] Assignee: Lawrence Peska Associates, Inc., New York, N.Y. ; a part interest

[22] Filed: Oct. 6, 1975

[21] Appl. No.: 620,170

[52] U.S. Cl. ..... 5/368; 5/349
[51] Int. Cl.[2] ..... A47C 27/08
[58] Field of Search ..... 5/348, 349, 350, 368, 5/369

[56] References Cited

UNITED STATES PATENTS

| | | | |
|---|---|---|---|
| 622,239 | 4/1899 | Lane | 5/349 |
| 3,772,717 | 11/1973 | Yuen et al. | 5/349 |

FOREIGN PATENTS OR APPLICATIONS

| | | | |
|---|---|---|---|
| 401,767 | 7/1971 | Australia | 5/348 R |
| 583,448 | 12/1946 | United Kingdom | 5/348 R |
| 432,171 | 7/1935 | United Kingdom | 5/348 R |

*Primary Examiner*—Paul R. Gilliam
*Assistant Examiner*—Andrew M. Calvert

[57] ABSTRACT

This disclosure pertains to an inflatable air mattress comprised of a plurality of longitudinal inflatable main tubes, adjacent to one another, and interconnected pneumatically by short lengths of hoses, transverse to the longitudinal axis of the main tubes. One valve assembly, used to inflate the entire apparatus, is fastened to one of the main tubes near the bottom of the mattress assembly. Each main tube has fastened to it, at each end thereof, a rubber-like annular ring, cemented within the inner surface of the tubes. A lightweight metallic solid rivet-shaped device has its shaft likewise cemented to the central hole in the rubber-like ring in such a fashion that the shaft end is closest to the center of each main tube. The rivet is adapted with a dome-like cap, at one end, which is external to the end of each main tube. The outermost circular edge of the dome-like cap is coincident with the circular edge corresponding to the outside diameter of the main tube, when inflated. Thus, two parallel sides of the mattress assembly have a permanent thickness which is equal to the thickness of the main tubes when they are inflated. The plurality of parallel main tubes, end closure assemblies comprising rubber rings and rivet shaped devices, valve, and interconnecting hoses are enclosed in a waterproof fabric-like flexible casing which can be removed by opening a zipper mechanism, located along a line midway between the upper and lowermost lateral surfaces of the mattress. The size of the inside diameter of the interconnecting hoses controls the rate of air flow between adjacent main tubes. This controls the apparent hardness of the mattress and the amplitude and rate of decay of the continued diminishing oscillatory motion experienced after the body of the user stops moving. Judicious selection of air pressure and the size of the internal diameter of the connecting hoses interrelate to affect the aforementioned hardness and "after bounce" effects.

8 Claims, 4 Drawing Figures

INFLATABLE AIR MATTRESS

BACKGROUND OF THE INVENTION

1. The Field of the Invention

This invention relates to that class of mattresses, beach pads, and camping gear comprised of flexible materials, which when inflated by air, develop a desired height and resiliency.

2. Description of the Prior Art

The prior art abounds with many schemes utilizing inflation of soft materials to form a mattress. Some methods employed heretofore, have individual compartments adapted with individual inflation valves. Other schemes include a tortuous path fabricated from two flat juxtaposed flexible fabric-like sheets which may be inflated with a single valve. Still other concepts of fabrication include an upper and lowermost sheet adapted with transverse gussets, intercommunicating air passageways, and a single valve for inflation. Still other schemes employed have two or more tortuous paths, each forming an independent airtight chamber, adapted to be alternately inflated and deflated. This method is utilized in hospitals or at home to prevent bed sores for those patients who are unable, due to paralysis, to change their position while confined in a bed. Another scheme utilizes two longitudinal individually inflatable tubes, positioned paralel to each other, and located along the long side edges of a mattress, such that upon alternate inflation, the patient is turned from side to side.

SUMMARY OF THE INVENTION

The instant invention is fabricated from a series of tubes, adjacent each other, transverse to the major length of the mattress thus formed. Each tube is pneumatically interconnected to its neighboring tube by a short length of hose, thus forming one air chamber which can be inflated by the introduction of air at any single point on the surface of any tube. All tube ends are sealed pneumatically by a hollow rubber-like annular ring, bonded to the tube's internal surface at each end of each tube. A lightweight metallic stubby solid rivet-shaped member has its shaft bonded to the central hole of the rubberlike ring. The dome-shaped cap of the rivet has its flat surface abutting the cut edge of the main tube and the rubber-like ring, such that the outer surface of the main tube, at its cut edge, corresponds with the outside diameter of the dome-shaped cap of the rivet. A single valve is installed in one of the main tubes near its undermost surface. A waterproof plastic or rubber-like casing encloses the entire assembly and can be removed by opening a zipper which is installed in the casing, such that the length of the zipper lies in a plane midway between the planes formed by the mattress' uppermost and lowermost lateral surfaces. The rivet and rubber-like ring assemblies forming a gusset-like wall along the parallel long sides of the mattress, prevent sagging when a user sits on either side edge. The entire mattress, by virtue of its novel construction, is virtually box-like in shape, and by the proper choice of materials, is light in weight.

A primary object of the instant invention is to provide an inflatable mattress which will support the user when placing weight on one of its long edges.

Another object is to provide a multichamber inflatable mattress which can be inflated with one valve.

Still another object is to provide pneumatic interconnections between each major chamber of the mattress by the use of small diameter tubes, thus providing a controlled rate of flow from one air chamber to another, minimizing or enhancing, as desired, rocking effects similar to that experienced by the user of a waterbed.

A further object is to provide an inflatable mattress which has side walls essentially perpendicular to the main lateral surfaces thereof.

Another object is to provide an inflatable mattress suitably protected with a lightweight waterproof outer casing facilitating cleaning.

These objects, as well as other objects, of this invention will become readily apparent after reading the following description of the accompanying drawings.

DESCRIPTION OF THE PREFERRED EMBODIMENT

Figure 1:
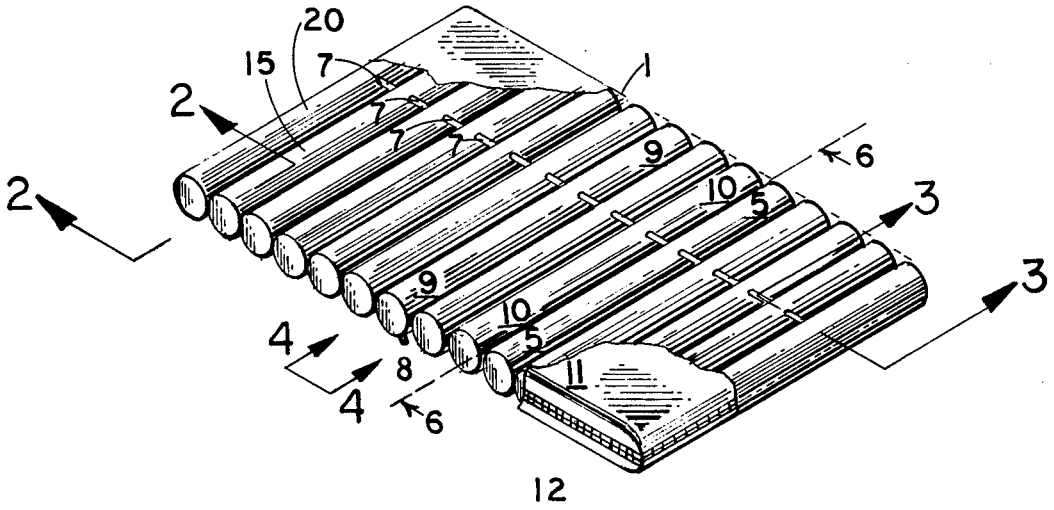
FIG. 1 is a perspective view of the inflatable mattress partially covered by the external casing.

The structure and method of fabrication of the present invention is applicable to an inflatable air mattress relatively lightweight in construction, compared to a conventional box spring mattress. The body of the mattress is comprised of a series of equal length parallel main hollow tubes each fabricated from rubber hose, or tubing which is, in turn, fabricated from flat strips of rubber or plastic material sealed together at the long edges. The structure thus formed is a solid rectangle whose height is equal to the diameter of the main tubes and whose length is equal to the number of tubes employed multiplied by the outside diameter of a tube. The width of the mattress assembly is equal to the length of any tube. Each main tube is in touching engagement with its neighboring tubes along lines lying in a plane defined by the longitudinal axis of each main tube. This plane is midway between and parallel to the uppermost and lowermost parallel lateral planes that are tangential to the uppermost and lowermost points of each main tube. The two long sides define planes which are parallel to each other and are transverse to the axis of a main tube. Adjacent main tubes may be joined together at the line of contact between each other, lying in the plane interstitial the uppermost and lowermost lateral planes, with adhesive, if desired, though a tightly enclosing overall casing can preclude the need therefore. Each tube at each end is pneumatically sealed by a rubber-like ring which is cemented to the inside surface thereof. The central hole in the rubber-like ring encloses the shaft of a stubby metallic solid lightweight rivet. Cement is used to join the shaft of the rivet to the interior wall of the central hole of the rubber-like ring. The dome-like cap of the rivet touches and projects outwardly from the end of the main tube. The diameter of the dome is equal to the inflated outside diameter of the main tube.

A plurality of hose lengths, having relatively narrow internal diameters, centered about a common longitudinal axis parallel to the long side of the mattress assembly, pneumatically join each main tube to a neighboring main tube, providing a path through which the air, which is utilized to inflate the mattress, communicates. There is one more main tube in number than the number of short hoses disposed on that line. Each end of each hose is cemented, or otherwise fastened in airtight fashion, to adjoining main tubes. I have discovered that placing the interconnecting hoses, each having an internal diameter of one half inch, in two lines, each some seven inchs from the free ends of a 56 inch main tube, creates the desired rate of air flow from one main tube to another when a body weight is placed on the mattress. If the hoses have an inside diameter which is larger, a higher rate of air flow is created between those main tubes subjected to heavier parts of the body to those main tubes which support lighter parts of the body. If the rate of air flow therebetween is high, body motion or body shifting on the mattress creates a mattress surface which oscillates in ever decreasing magnitude for a period of time after the body motion ceases. The effect is very similar to the continuing sustained undulations experienced when utilizing a waterbed. The higher the pressure within the mattress, the lesser the waterbed effect. Additionally, the larger diameter of the interconnecting hoses or the greater number of interconnecting hoses, the greater the effect. A proper selection of the number of lines of interconnecting hoses and their internal diameter, in combination with a given air pressure, creates a mattress which can be firm in the conventional box spring sense at one extreme, to a mattress which is waterbed-like at the other extreme.

A single self-closing valve is installed below the midline of a main tube and is not permitted to project below the lowermost surface of the tube.

A flexible, preferably waterproof fabric-like material, such as closely woven polyamide plastic monofilament, is utilized to fabricate an overall casing. The casing is removed from about the inflatable internal structure of the mattress, by opening a zipper, installed on the casing, along outermost lines lying in the midplane intermediate the uppermost and lowermost lateral surfaces. Cleaning of the mattress casing can be accomplished with soap and water without fear that any liquid will seep through the casing material.

Now referring to the Figures, and more particularly to the embodiment illustrated in FIG. 1 showing the internal construction of the inflatable mattress 1 in perspective view. A main tube 10 joins an adjacent main tube 5 at adjoining line 6 which is parallel to the longitudinal axis of each main tube. One row of interconnecting hoses 7 is illustrated providing an air path between each of the main tubes. An air valve 8 is fastened in airtight fashion to a main tube 9 near one end thereof. The casing 11 is shown cut away in part to illustrate the components contained within it. All adjacent tubes may be cemented together at their contacting lines parallel to line 6 as shown, to enhance structural rigidity and minimize destructive forces on the interconnecting hoses 7, when the inflatable apparatus is removed from its casing 11. In practical use, the casing totally encloses and conceals the inflatable internal structure. A zipper 12 is installed at the free edges of the casing and when parted, permits the inflatable internal structure to be withdrawn from within the casing. I have found that minimally, the zipper should traverse the entire length of one side and continue to traverse, at the midline, the entire width at one end of the mattress. This facilitates simple insertion and removal of the internal inflatable structure.

Figure 2:
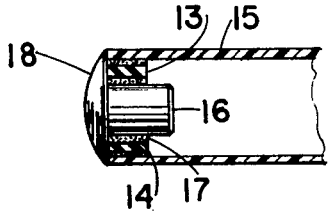
FIG. 2 is a cross-sectional side elevation view taken through line 2—2 viewed in the direction of arrows 2—2 as shown in FIG. 1.

FIG. 2 is a side elevation view of one end of one main tube designated by the numeral 15. A rubber annular ring 13 is cemented on its outer surface 14 to the inner surface of the tube 15 at a free end thereof. A lightweight stubby metallic solid rivet 16, preferably fabricated from aluminum, is cemented by adhesive layer 17 to the central hole of the rubber ring 13. The dome-shaped cap 18 of the rivet 16 abuts the free edge of the tubing 15. An airtight main tube end closure is thus created. All ends of all main tubes are similarly adapted with this form of airtight closure.

Figure 3:
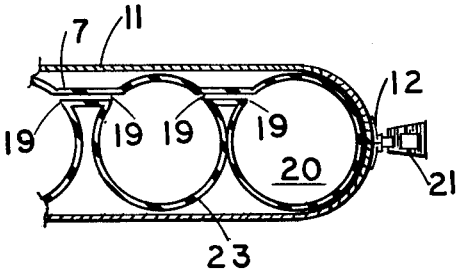
FIG. 3 is a cross-sectional side elevation view taken through line 3—3 viewed in the direction of arrows 3—3 as shown in FIG. 1.

FIG. 3 illustrates the cross-sectional view of the interconnecting hoses 7 which are cemented to the walls of the holes 19 in each of the main tubes. The two main tubes 20 at the short ends of the mattress are adapted with a single hole 19, contrasted with an intermediate tube 23 required to have two holes 19 for each line of interconnecting hoses 7. The casing 11 is illustrated in tangential contact with the main tubes enclosed thereby and in semi-circumferential contact with the end tube 20. Pull tab 21 is used to close and open zipper 12 when in the position illustrated. At all other times tab 21 lies in a plane adjacent and parallel to the surface of the zipper.

Figure 4:
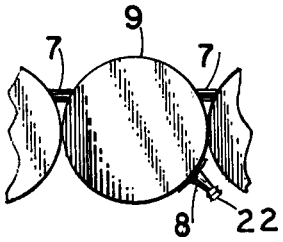
FIG. 4 is a partial side end view taken through line 4—4 viewed in the direction of arrows 4—4 as shown in FIG. 1.

FIG. 4 illustrates the installed position of valve 8 on main tube 9. The valve 8, as illustrated, may be of the type used on inner tubes in automotive tire applications. The valve has a threaded end 22 which can accommodate an internally threaded plastic cap, not shown, preventing accidental seepage of air. A conventional foot clamped hand operated reciprocating portable air pump may be connected to the threaded end 22 and used to inflate the entire internal inflatable structure.

One of the advantages is an inflatable mattress which will support the user when placing weight on one of its long edges.

A further advantage is a multichamber inflatable mattress which can be inflated with one valve.

Another advantage is pneumatic interconnections betweenn each major chamber of the mattress by the use of small diameter tubes, thus providing a controlled rate of flow from one air chamber to another minimizing or enhancing, as desired, rocking effects similar to that experienced by the user of a waterbed.

Still another advantage is an inflatable mattress which has side walls essentially perpendicular to the main lateral surfaces thereof.

A further advantage is an inflatable mattress suitably protected with a lightweight waterproof outer casing facilitating cleaning.

Thus, there is disclosed in the above description and in the drawings, an embodiment of the invention which fully and effectively accomplishes the objects thereof. However, it will be apparent, to those skilled in the art, how to make variations and modifications to the instant invention. Therefore, this invention is to be limited not by the specific disclosure herein, but only by the appending claims.

The embodiments of the invention in which an exclusive privilege or property is claimed are defined as follows:

I claim:

1. An air mattress comprising a plurality of rubber-like tubes, each having a longitudinal axis lying within a first plane, each of said tubes engaging neighboring said tubes along joining lines lying within said first plane, each of said tubes having the same length, the free ends of said rubber-like tubes forming two parallel planes transverse to said longitudinal axis and said first plane, a plurality of relatively shorter interconnecting hoses forming an air passage between adjoining said rubber-like tubes the axis of each lying in an air passage line transverse said longitudinal axis, an air valve fastened to one of said rubber-like tubes, the shaft of a solid metallic rivet cemented within a rubber-like ring, said ring cemented to the interior surface of the free end of each of said rubber-like tubes, an overall waterproof fabric-like casing enclosing said plurality of rubber-like tubes, said interconnecting hoses, said metallic rivets, said rubber-like rings, and said valve, a zipper closure device lying within said first plane adapted to fasten free edges of said casing to form a unitary enclosure, said casing providing parallel lateral second and third planes centrally between which lies said first plane in parallel relationship thereto.

2. The air mattress of claim 1 wherein adjoining said rubber-like tubes are fastened together along the length of said joining lines.

3. The air mattress of claim 1 wherein said interconnecting hoses are positioned along a line intermediate said one set of adjacent free ends of said rubber-like tubing, and a parallel line midway between both sets of adjacent free ends of a said rubber-like tube.

4. The air mattress of claim 1 wherein said casing is comprised of a fabric woven from polyamide plastic monofilaments.

5. The air mattress of claim 1 wherein said metallic rivet is fabricated from aluminum.

6. The air mattress of claim 1 wherein said valve is self-closing.

7. The air mattress of claim 1 wherein said zipper, lying in said first plane, is installed alongside two adjacent sides of said casing.

8. The air mattress of claim 1 employing a plurality of interconnecting hoses centered about lines parallel to the said air passage line.

* * * * *